US005588873A

United States Patent [19]

Hamai et al.

[11] Patent Number: 5,588,873

[45] Date of Patent: Dec. 31, 1996

[54] CONNECTOR ADAPTED FOR FIT DETECTION

[75] Inventors: Tsuyoshi Hamai; Norimichi Yashima, both of Shizuoka, Japan

[73] Assignee: Yazaki Corporation, Tokyo, Japan

[21] Appl. No.: 545,088

[22] Filed: Oct. 19, 1995

[30] Foreign Application Priority Data

Oct. 19, 1994 [JP] Japan ..... 6-253614

[51] Int. Cl.[6] ..... H01R 3/00

[52] U.S. Cl. ..... 439/489; 439/491; 439/955

[58] Field of Search ..... 439/488, 489, 439/491, 955

[56] References Cited

U.S. PATENT DOCUMENTS 4,902,244 2/1990 Endo et al. ..... 439/489
4,925,402 5/1990 Inaba et al. ..... 439/491 X
5,169,329 12/1992 Taguchi ..... 439/354 X
5,169,336 12/1992 Taguchi ..... 439/354 X

FOREIGN PATENT DOCUMENTS 1-294384 11/1989 Japan .

*Primary Examiner*—Khiem Nguyen
*Attorney, Agent, or Firm*—Morgan, Lewis and Bockius LLP

[57] ABSTRACT

A connector which includes a female housing and a corresponding male housing. The female housing has a bar code configuration printed on its outer circumferential wall. A single slit is pierced through the circumferential wall of the female housing within an area of a single bar contained in the bar code configuration. The slit's position corresponds to the point where the leading end of the male housing reaches when it achieves a complete fit with the female housing. The part of the male housing which, when in the complete fit position, corresponds to the slit's position should be the same color as was the area of the female housing's wall that was displaced by the slit.

6 Claims, 11 Drawing Sheets

A=[B1-W2-B1-W1-B1-W1-B2-W1-B1]

A=[B1-W2-B1-W1-B1-W1-B2-W1-B1]

C=[B1-W1-B1-W1-B2-W1-B1-W2-B1]

A = [ B1-W2-B1-W1-B1-W1-B2-W1-B1 ]

C = [ B1-W1-B1-W1-B2-W1-B1-W2-B1 ]

A = [ B1-W2-B1-W1-B1-W1-B2-W1-B1 ]

C=[B1-W]-B1-W1-B2-W1-B1-W2-B1]

CONNECTOR ADAPTED FOR FIT DETECTION

BACKGROUND OF THE INVENTION

1. Field of the Invention

The invention relates to a connector which uses a bar code to facilitate discrimination between types of connectors and detection of a fit failure between the male and female housing.

2. Discussion of the Related Art

Conventionally, connectors are known in which a bar code is configured by slits in order to enable both discrimination between types of connectors and detection of fit failure. FIGS. 7 to 10 show conventional connectors similar to those disclosed in Japanese Patent Publication (Koai) HEI1-294384.

Referring to FIG. 7, the connector 1 comprises a female housing 2, and a male housing 3 which is to be inserted into a fitting hole 2*a* of the female housing 2. When the leading end of the male housing 3 is moved closer to or butts against an end wall 2*b* of the fitting hole 2*a*, a complete fit of the male housing 3 into the fitting hole 2*a* is attained. A lock groove 4 is formed in an upper portion of a circumferential wall 2*c* of the fitting hole 2*a* of the female housing 2, and a lock portion 5 is correspondingly formed on an upper face of the male housing 3. These components are locked together in a complete fit condition, so as to prevent the housing 3 from slipping off the housing 2.

A plurality of slits 6A, 6B, 6C, and 6D each having a predetermined width are opened in a side portion of the circumferential wall 2*c* of the female housing 2. The slits elongate vertically and are arranged in parallel to each other with gaps along the connector fitting direction. These slits 6A to 6D constitute respective bars of a bar code so as to represent a code which is specific to the connector.

The side face of the male housing 3 facing the slits 6A to 6D includes an indicating portion 7. A black coating material is applied on the indicating portion 7. In the complete fit condition, the indicating portion 7 indicates black bars in accordance with the respective widths of the slits 6A to 6D, and all of the bars constitute the bar code. Although not shown in the Figure, a male terminal piece is disposed inside the female housing 2, and a female terminal piece inside the male housing 3.

A bar-code reader is used as a reading apparatus in an inspection procedure. The bar-code reader optically reads the bar code configured by the slits 6A to 6D formed in the female housing 2 and the indicating portion 7 of the male housing 3. The bar-code reader comprises a detecting scanner 8 which performs optical scanning, and a calculation unit (not shown) which judges whether or not the fit condition is achieved based on the optical information obtained by the scanner 8 and discriminates a code associated with that type of connector in accordance with the widths of the slits 6A to 6D.

Bar-codes corresponding respectively to the kinds of connectors are previously registered in the calculation unit. The calculation unit judges which of the previously registered bar codes the optical data detected by the scanner 8 corresponds to, and specifies the kind of the connector that was inspected. When a detected output is not included in the previously registered bar codes, that is, when the detected output does not correspond to any one of the registered bar codes, the fit condition is judged to be a failure, and an alarm is issued.

In the above-described configuration, if the male housing 3 is not fitted into the female housing 2 as shown in FIG. 7(*a*), a light passes through all the slits 6A to 6D as shown in FIG. 7(*b*). As a result, no waveform is output, and the calculation unit judges that there is no corresponding bar code, i.e., that the fit is a failure.

In the case of an incomplete fit as shown in FIG. 8(*a*), the black color of the indicating portion 7 of the male housing 3 constitutes the black bars in the portions of the slits 6A to 6C as shown in FIG. 8(*b*). As a result, the scanner 8 outputs a waveform. In the last slit 6D, light from the scanner 8 passes through the slit 6D so that no waveform is output for this portion. The calculation unit searches for a bar code waveform which corresponds to the output waveform of the whole bar code, and then judges that there is no corresponding bar code, i.e., that the fit is a failure.

A complete fit condition is shown in FIG. 9(*a*), and the portion of the last slit 6D is filled with the black indicating portion 7 so that the portion constitutes a black bar and a complete bar code is configured. Accordingly, the scanner 8 outputs a waveform corresponding to one of the bar codes which is formally registered. As a result, the calculation unit judges that the fit condition is achieved, and discriminates the kind of the connector.

FIG. 10 shows another conventional example.

In FIGS. 7–9, the portions which are observed through the slits 6A to 6D (the indicating portion 7) are colored in black. In the connector shown in FIG. 10, the portions which are observed through the slits 6A to 6D (the indicating portion 7) are colored in a white-tone color such as silver (if the foundation color is white, the coloring is not required), and the periphery of each of the slits 6A to 6D is colored in black. That is, in the connector, a black coating material 10 is applied in a rectangular shape to the side portion of the female housing 2, and each of the slits 6A to 6D is formed in an area surrounded by the black coating material 10. The side face of the male housing 3 corresponding the slits 6A to 6D is coated with a reflective coating, such as the color silver.

The connector, the arrangement of the black coated portion, and the white portions which are observed through the slits 6A to 6D (the portions coated with the reflective coating material of silver or the like) constitutes a bar code which corresponds to a type of connector. In the case of this connector, the waveform from the scanner 8 is output in a form which is inverted from that in the above-described example.

In the example shown in FIG. 10, a detection start code 20 and a detection stop code 21 which are similarly configured by black bars are respectively applied on both the front and rear portions of the rectangular black coating material 10 so that the detection start and end of the scanner 8 are represented by the bar code. Accordingly, it is possible to perform the inspection of connectors one by one.

FIGS. 11(*a*), 11(*b*), and 12 show an example of a female housing 12 in another connector having a different shape.

The female housing 12 of the connector is the same as the female housing 2 shown in FIG. 10 in arrangement and size of the slits 6A to 6D constituting a bar code, and the like, but different in shape. Specifically, a fitting hole 12*a* is formed in the front portion of the female housing 12, and an end wall 12*b* against which a leading end of the male housing butts is disposed in the innermost portion of the fitting hole 12*a*. Slits 6A to 6D are formed in the side portion of a circumferential wall 12c. White portions which are observed through the slits 6A to 6D (the indicating portion of the male housing), and the remaining portion of the black coating material 10 around the slits 6A to 6D (the portion which is left as a result of the formation of the slits) constitute a bar code 30(A) of pattern A. In FIG. 12, the reference numerals are attached so as to indicate bars obtained when the bar code 30(A) of pattern A is constituted.

The bar code 30(*a*) of pattern A consists of black bars "B" and white bars "W" arranged in the following sequence starting from the front end side (the front end side in the fitting direction). Herein, "B1" and "W1" indicate bars with a narrower width (a width of D1), and "B2" and "W2" indicate bars with a wider width (a width of D2).

Pattern A="B1-W2-B1-W1-B1-W1-B2-W1-B1"

FIGS. 13(*a*), 13(*b*), and 14 show a female housing 22 of another-connector having a different shape. The female housing 22 of the connector has a shape which is somewhat different from that of the female housing 12 shown in. FIG. 11, and the arrangement and size of the slits 6A to 6D of the bar code are different from those of the pattern shown in FIG. 11. Specifically, a fitting hole 22*a* is formed in a front portion of the female housing 22, and an end wall 22*b* against which a leading end of the male housing butts is disposed in the innermost recess of the fitting hole 22*a*. Slits 6A to 6D are formed in the side portion of a circumferential wall 22*c*. White portions which are observed through the slits 6A to 6D (the indicating portion of the male housing) and the remaining portion of the black coating material 10 around the slits 6A to 6D (the portion which is left as a result of the formation of the slits) constitutes a bar code 30(C) of pattern C. In FIG. 14, the reference numerals indicate bars obtained for the bar code 30(C) of pattern C.

The bar code 30(C) of pattern C consists of black bars "B" and white bars "W" arranged in the following sequence starting from the front end side. Herein, "B1" and "W1" indicate bars with a narrower width, and "B2" and "W2" indicate bars with a wider width.

Pattern C="B1-W1-B1-W1-B2-W1-B1-W2-B1"

Code patterns other than these can be produced by arranging the black and white bars of two kinds (two kinds of different widths) "B1", "B2", "W1", and "W2". If the width of each bar is changed with smaller differences, more kinds of bar codes can be produced. Herein, however, the case of widths of two kinds is only described by way of example.

Conventionally, as described above, a bar code pattern is set for each different shape of connector. Since a single mode can only produce one type of housing, and since a plurality of slits 6A to 6D are arranged so as to constitute a bar code, a single mold can only produce one code pattern for any given shape of a female housing. Therefore, a distinguishing bar code pattern is set for each mold. For example, in the case where the female housing 12 shown in FIGS. 11 and 12 is to be formed, the bar code of pattern A is set, and, in the case where the female housing 22 shown in FIGS. 13 and 14 is to be formed, the bar code of pattern B is set.

For the above-mentioned reason, in the case where identically shaped connectors are required to be distinguished, it is necessary to prepare another mold having a different arrangement of slits 6A to 6D. This is not economically efficient. As a result, the number of bar code patterns cannot be increased, i.e., the number of distinguishable kinds cannot be increased. If, for example, the bar code 30(C) of pattern C shown in FIG. 14 is to be attached to the female housing 12 shown in FIGS. 11 and 12, a new mold needs to be prepared.

SUMMARY OF THE INVENTION

The present invention has been made in view of the above circumstances and has an object to provide a connector to which various kinds of bar codes can be attached while using a common mold.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the connector according to the invention comprises a female housing and a male housing which is fitted into a fitting hole of the female housing, a leading end of the male housing reaching a given position in the fitting hole in a complete fit condition, a bar code configured by a combination of bars of different colors is printed on a slit which pierces a circumferential wall of said female housing from the outer face to an inner face is formed within an area of a bar of one of the colors in a position which corresponds to the given position, and an indicating portion of the same color as the one color is disposed in a portion of a side face of the male housing corresponding to the slit.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENTS

Figure 1A:
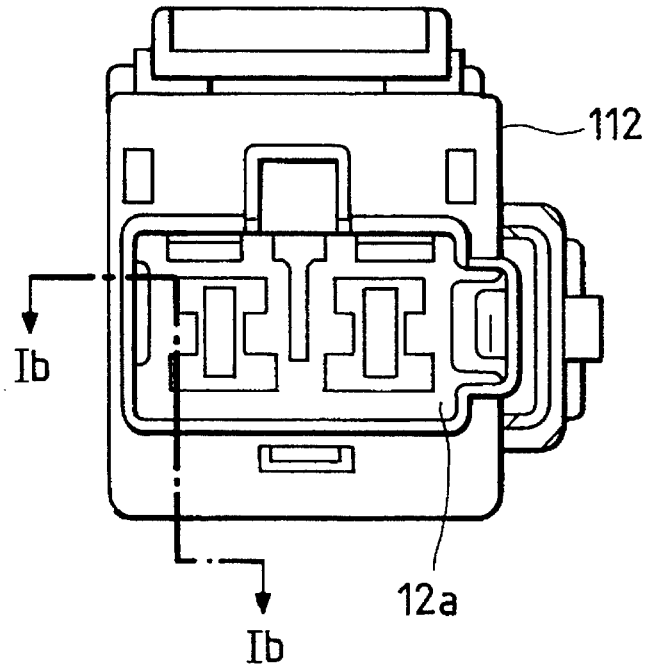
FIG. 1 is an external view of a female housing at a connector of an embodiment of the invention, FIG. 1(*a*) is a front view, and FIG. 1(*b*) is a plan view along section Ib—Ib.

According to a preferred embodiment, when the male housing is completely fitted into a female housing, the leading end of the male housing reaches the given position in the fitting hole of the female housing, and hence the indicating portion of the male housing is positioned at the back of the slit. The slit is filled with the indicating portion having the same color as that of the bar in which the slit is formed, so that the bar has no void. As a result, the bar which has a predetermined width and in which the slit is formed is read by a bar-code reader as having its original width, and a waveform output is obtained in accordance with the printed bar code pattern. A corresponding bar code pattern is searched for, and the kind of connector is then determined.

On the other hand, when the male housing is not fully fitted into the female housing, or is in a fit failure condition, the leading end of the male housing does not reach the desired position in the fitting hole of the female housing. Therefore, the male housing is not positioned at the back of the slit. The slit therefore has a void in the bar which has the predetermined width, and light from the bar-code reader passes through the slit. As a result, the waveform pattern is different from the waveform pattern which is to be obtained in the complete fit condition. Accordingly, the fit condition is judged to be a failure.

According to another preferable embodiment, the colors of the bars which comprise the bar code should be a white-tone and a black-tone color.

According to yet another preferred embodiment, the width of the slit is set to be equal to or smaller than the width of a bar having the minimum width among plural kinds of bar code patterns to be employed. When a single kind of female housing is formed, many bar code patterns can be employed in conjunction with the slits.

The color of the material of the female housing and the male housing is preferably the same as the color of the bar of the one color which the slit pierces. The portion corresponding to the bar of the color is not printed the foundation color), and only the bars of the other color are printed, so that a bar code is configured. In the case where the material color is white, for example, a bar code can be configured by printing only black bars, and the slit can be positioned in a white-toned bar. In this case, the color of the indicating portion of the male housing can be left as its foundation color. When the complete fit condition is attained and the indicating portion of the male housing is positioned at the back of the slit, the slit is filled with the indicating portion of the white-tone color. As a result, the bar of the white-tone color has no void, and the bar having its original width can be read by the bar-code reader. In a fit failure condition, the opening of the slit is not filled with the male housing, but remains open. The slit constitutes a void in the bar of the white-tone color, and the waveform read from the bar of the white-tone color is different from that which is obtained in the complete fit condition. Accordingly, the fit is judged to be a failure.

Hereinafter, an embodiment of the invention will be described with reference to the accompanying drawings.

Figure 1B:
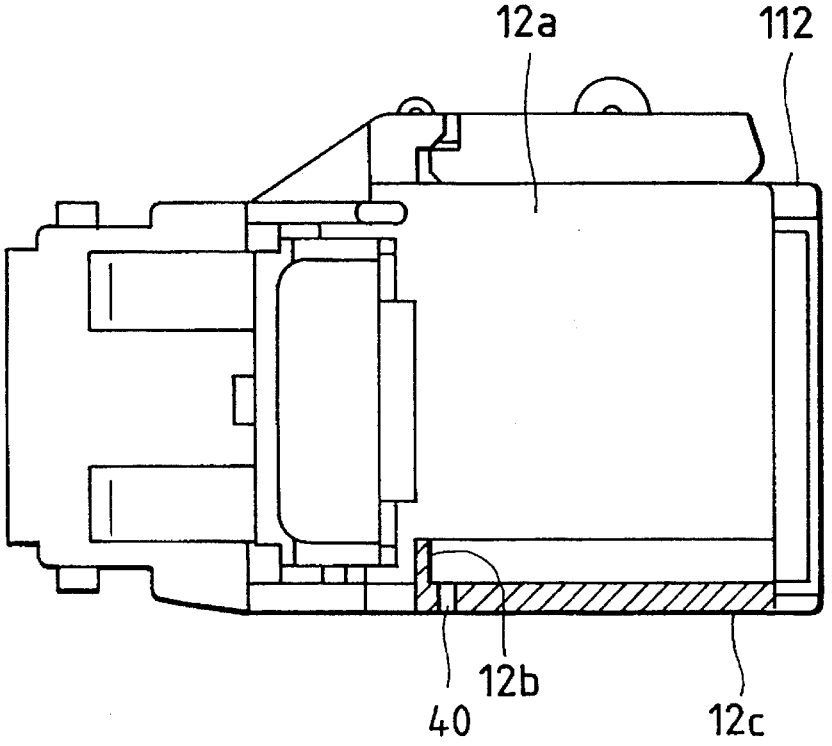
Figure 2:
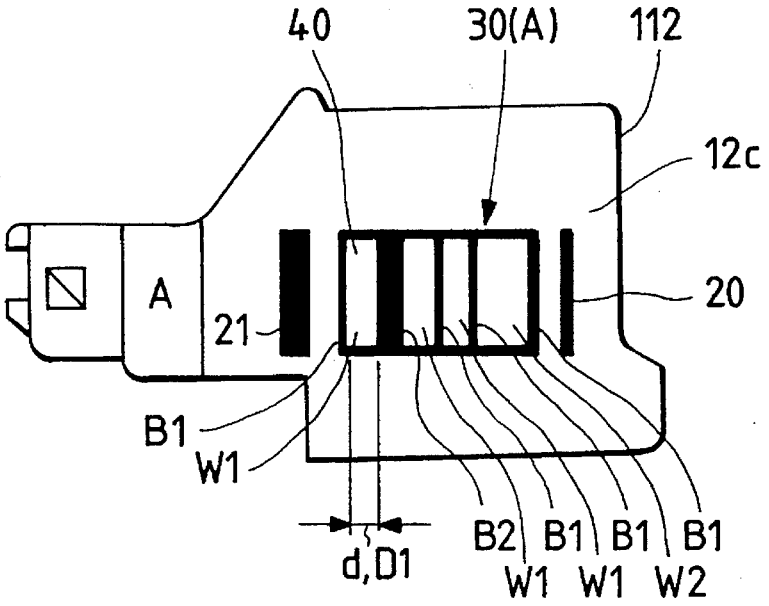
FIG. 2 is a side view of the female housing shown in FIG. 1.
Figure 3:
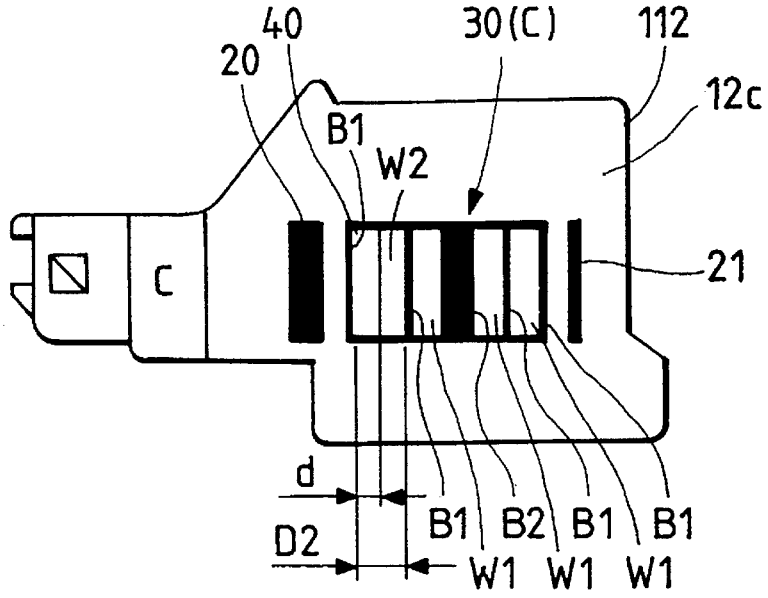
FIG. 3 is a side view showing an example where a bar code different from that in FIG. 2 is printed on the female housing shown in FIG. 1.
Figure 11A:
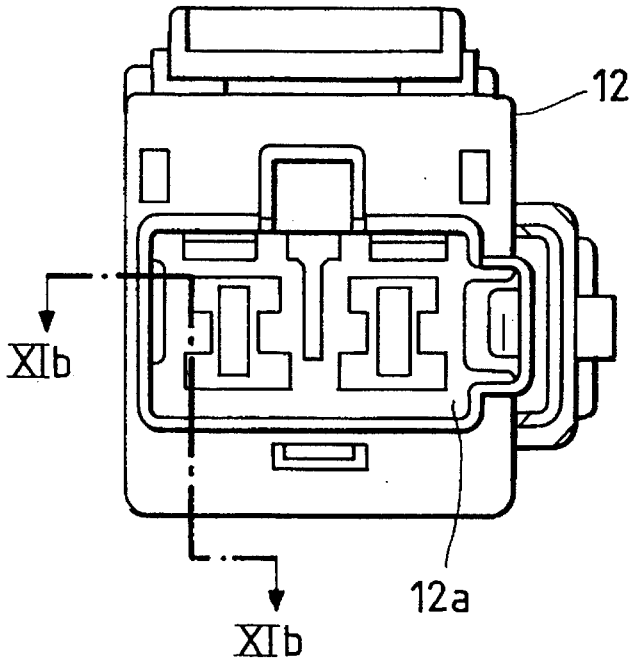
FIG. 11 is an external view of a female housing of yet another conventional connector, FIG. 11(*a*) is a front view, and FIG. 11(*b*) is a plan view along section XIb—XIb.
Figure 11B:
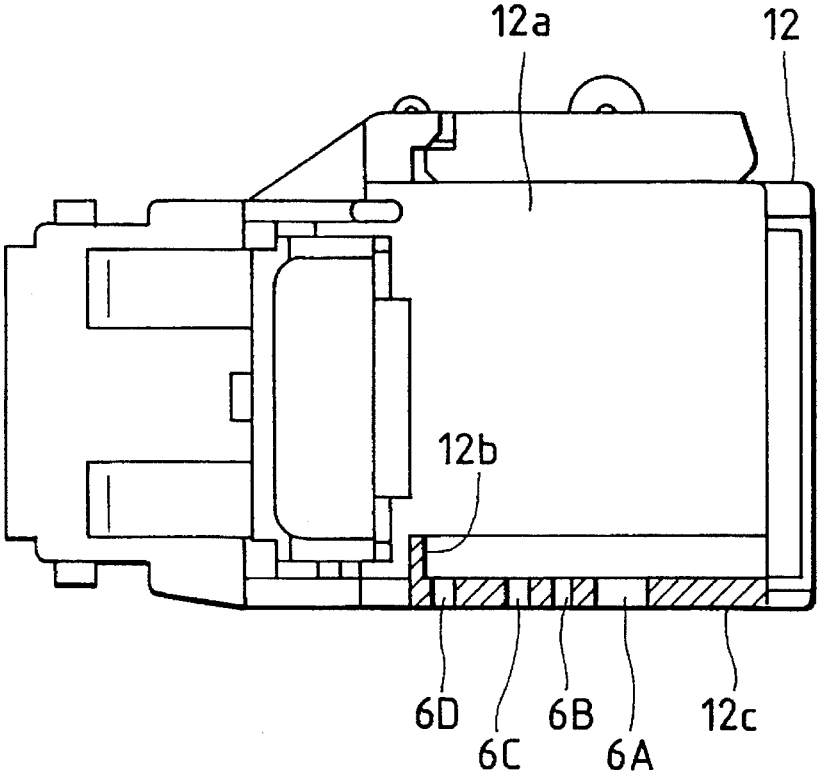

FIGS. 1(*a*) and 1(*b*) show the configuration of a female housing 112 in a connector of a first embodiment. FIGS. 2 and 3 show examples of bar codes 30A) and 30C) printed on a side face of the female housing 112. The shape of the female housing 112 may be substantially similar to that shown in FIG. 11 except that only a single slit 40 is disposed at the end in the fitting direction.

Figure 8A:
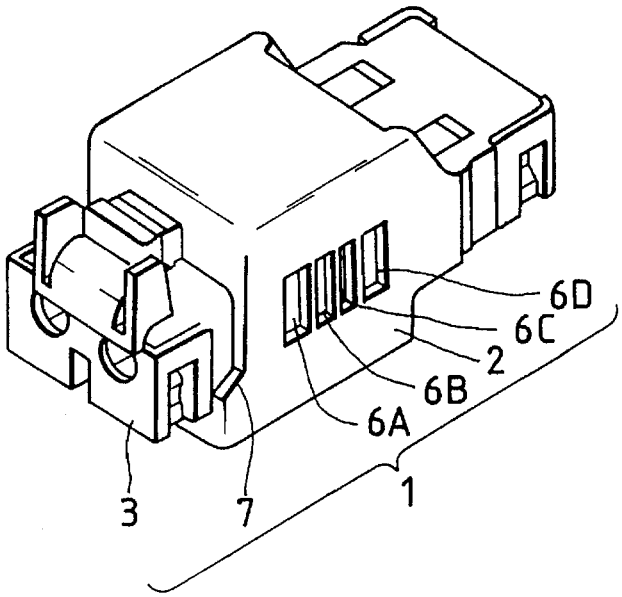
FIG. 8 is a view showing a fit failure condition of a conventional connector, FIG. 8(*a*) is a perspective view, and FIG. 8(*b*) is a section view showing a bar code being read by a scanner.
Figure 8B:
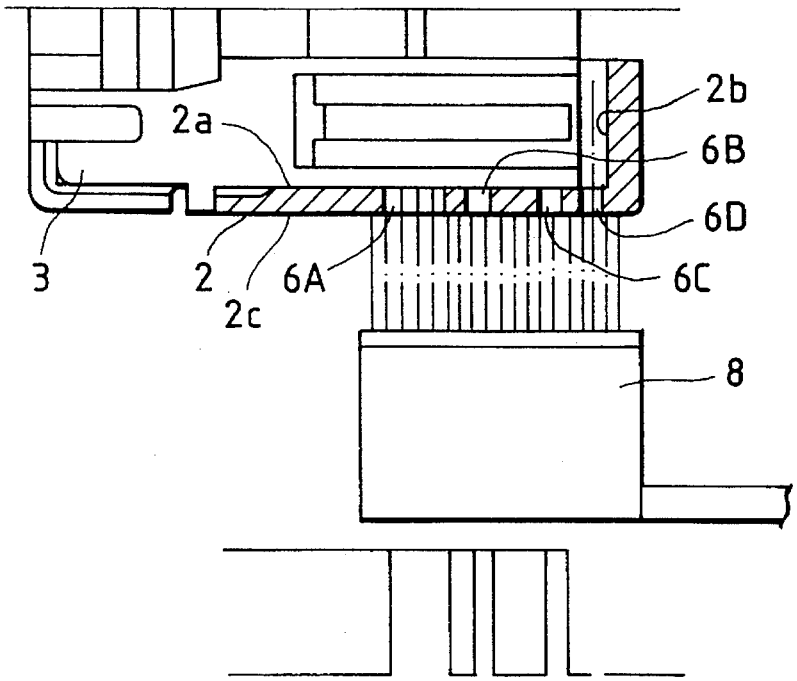
Figure 9A:
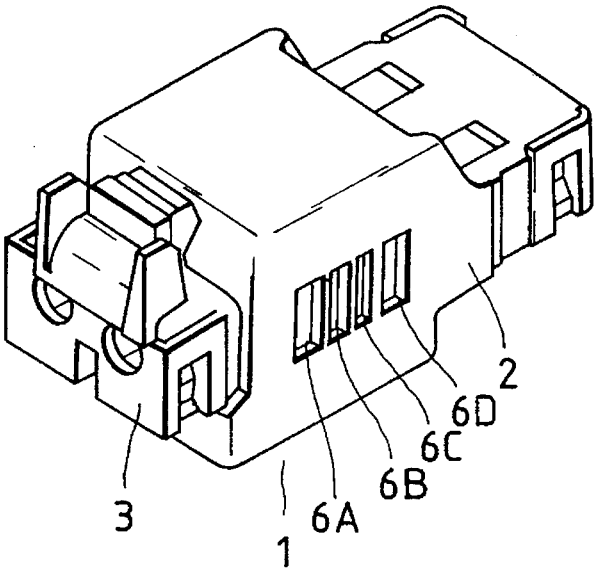
FIG. 9 is a view showing the complete fit condition of a conventional connector, FIG. 9(*a*) is a perspective view, and FIG. 9(*b*) is a section view showing a bar code being read by a scanner.
Figure 9B:
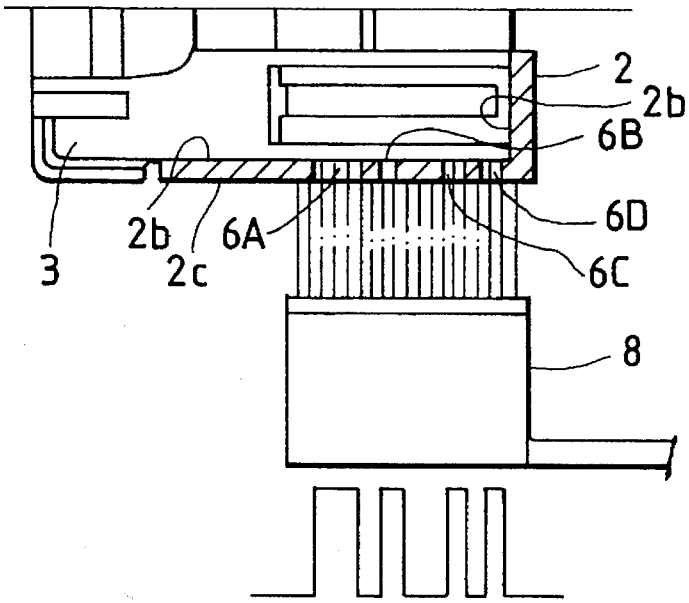
Figure 10:
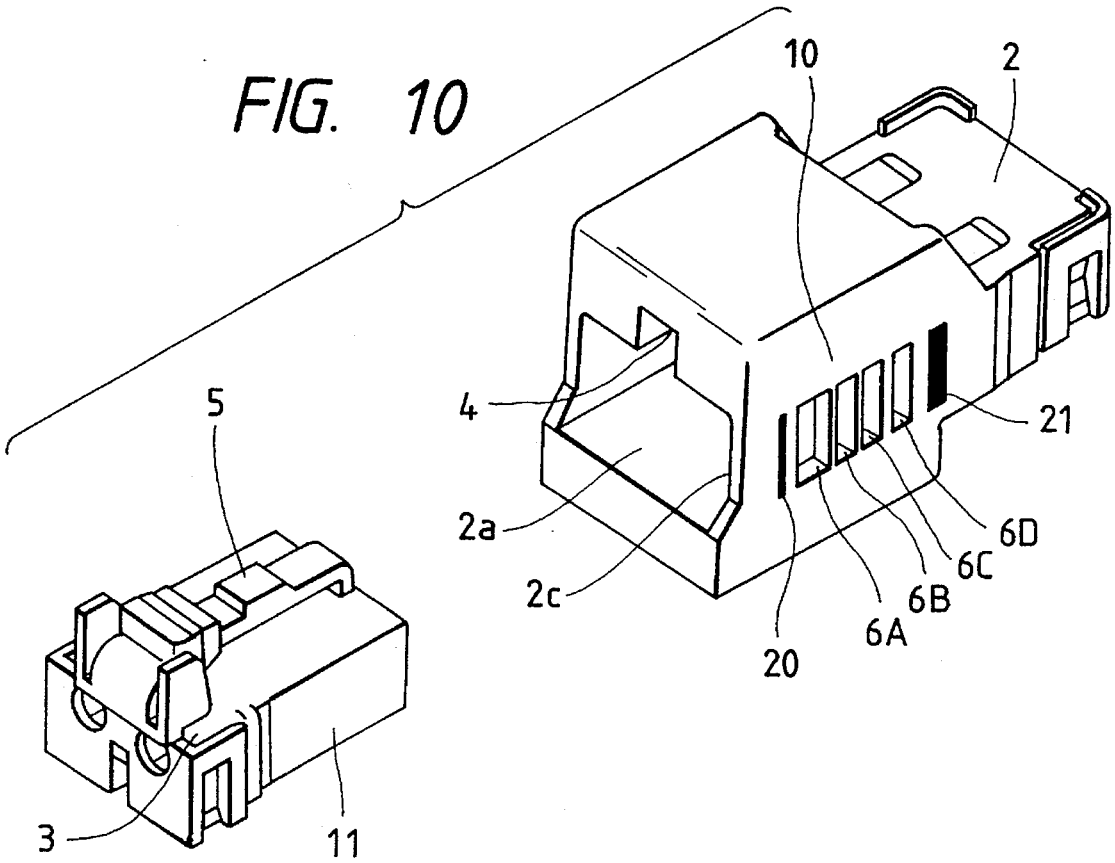
FIG. 10 is an external perspective view of another conventional connector.
Figure 12:
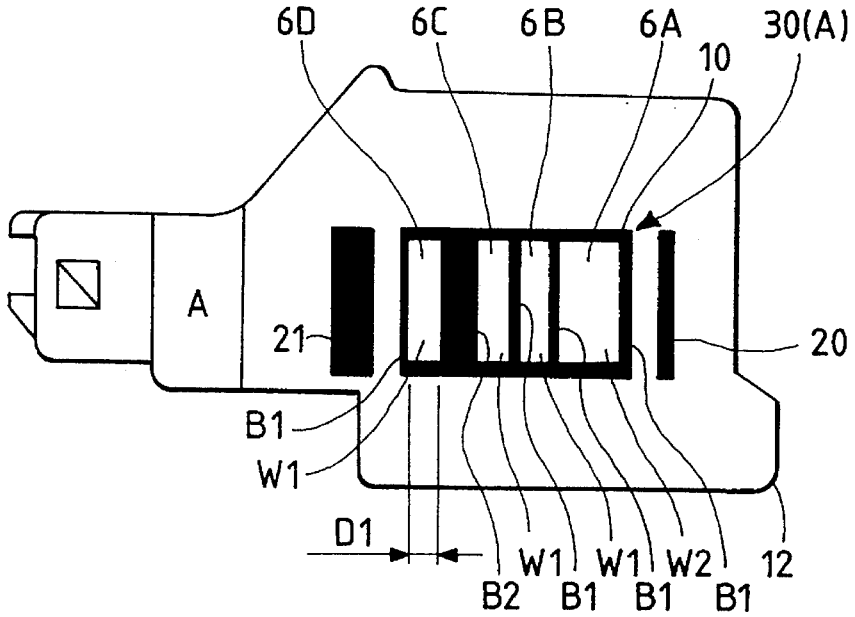
FIG. 12 is a side view of a female housing shown in FIG. 11.

It is seen from the description of the prior art that the last slit is key to the final fit detection, that is, the slit 6D see FIG. 8) corresponding to the position immediately before the end wall. In the embodiment, the bar codes 30A) and 30C) for discriminating the kinds of the connectors are not formed by slits, but are printed on an outer face of the side portion of the circumferential wall 12*c* of the female housing 112. A single slit 40 which pierces the circumferential wall 12*c* from the outer face to the inner face is disposed only in a position required for the fit detection.

A preferred feature is that, among the black bars B1 and B2 and the white bars W1 and W2 constituting the bar codes 30A) and 30C), the white bar W1 or W2 is printed in a position corresponding to a position immediately before the end wall 12*b* as shown in FIG. 1(*b*), position 12*b* is the desired position which is reached by the leading end of the male housing. A slit 40 is then formed within the area of the white bar W1 in that position. The width d of the slit 40 is set to be equal to or smaller than the width D1 of the white bar W1. The slit is thus equal to or smaller than a bar which has the minimum width among the employed bar code patterns. In the embodiment, D1=d.

The female housing 112 and the paired male housing are preferably resin molded products of a white-tone color. The bar codes 30(A) and 30(C) are printed so that portions of the white bars W1 and W2 of the bar codes 30A) and 30C) are not colored, and only the portions of the black bars B1 and B2 are colored. The indicating portion of the male housing which corresponds to the slit 40 in the complete fit condition has the same foundation color as that of the white bar W1 or W2, and hence the indicating portion is not colored.

When female housings 112 having the same slit 40 are formed in the above-mentioned manner, any desired bar code pattern can be printed on the female housing 112 depending on the assortment needed. For example, the bar code 30A) of pattern A may be attached as shown in FIG. 2, and alternatively the bar code 30C) of pattern C may be attached to the female housing 112 having the same slit 40 formed in the same manner as shown in FIG. 3. It should be appreciated that other bar code patterns in addition to the above-mentioned exemplary kinds can be printed. In any case, since the color of the indicating portion of the male housing in the embodiment is white, it is necessary to position the slit 40 within the area of the white bar W1 or W2.

For connectors having an identical shape, therefore, a single mold can be used to produce female housings on which differing bar codes can be printed. Accordingly, the embodiment can increase the number of kinds of connectors allowed, while reducing the cost.

The inspection whether the fit condition is achieved or not can be performed in the conventional way. Specifically, when the complete fit condition is attained and the indicating portion of the male housing is positioned at the back of the slit 40, the opening of the slit 40 is filled with the indicating portion of white-tone color. Therefore, the white bar W1 has no void, so that the bar W1 or W2) having its original width is read by the bar-code reader. In a fit failure condition, the opening of the slit 40 is not filled with the male housing, but remains at least partially opened. The unfilled slit 40 forms a void in the white bar W1 or W2), so that the waveform read from the white bar W1 or W2) is different from that which is obtained in the complete fit condition. As a result, the fit condition is judged to be a failure.

Figure 4A:
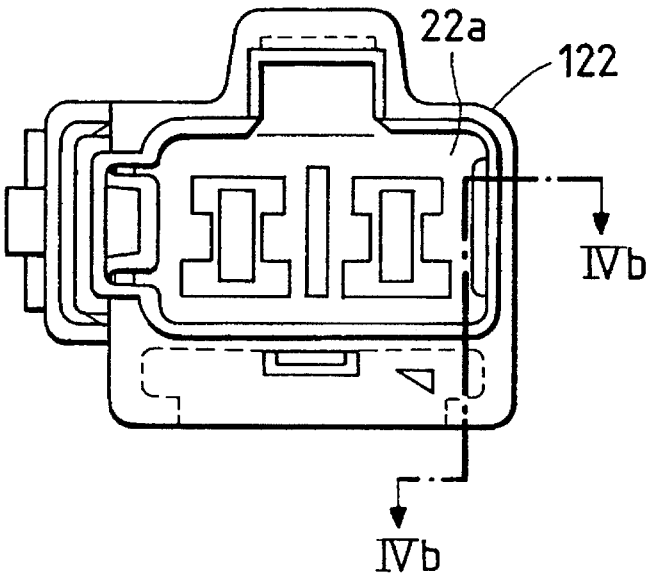
FIG. 4 is an external view of a female housing constituting a connector of another embodiment of the invention, FIG. 4(*a*) is a front view, and FIG. 4(*b*) is a plan view a long section IVb–Ivb.
Figure 4B:
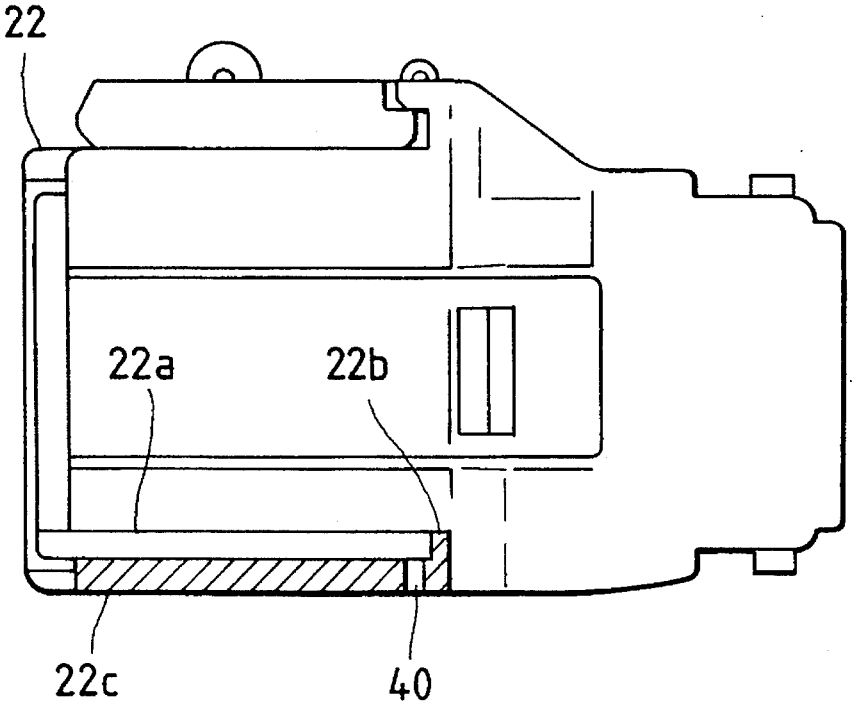
Figure 5:
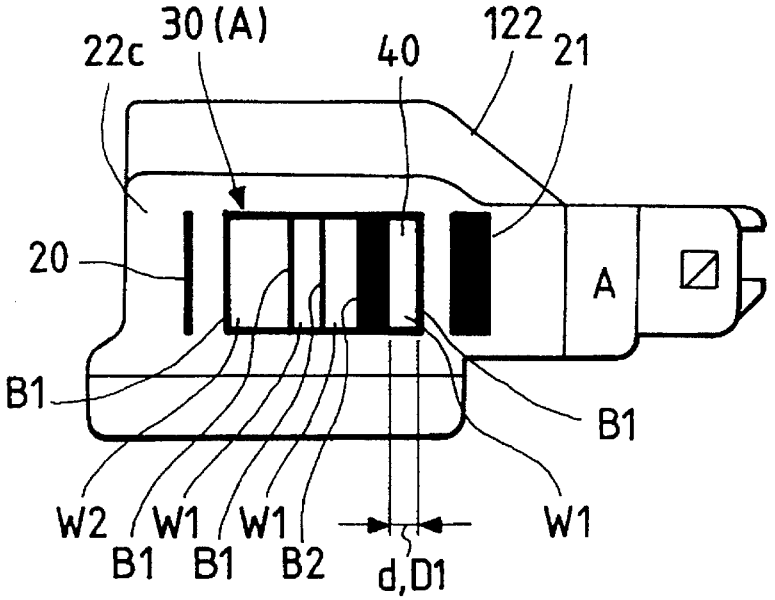
FIG. 5 is a side view of a female housing shown in FIG. 4.
Figure 6:
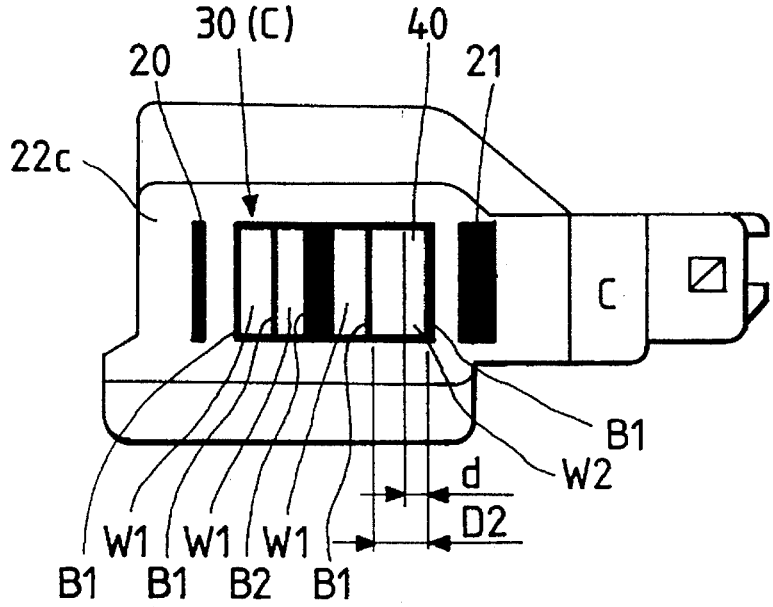
FIG. 6 is a side view of an example where a bar code different from that in FIG. 5 is printed on the female housing shown in FIG. 4.
Figure 7A:
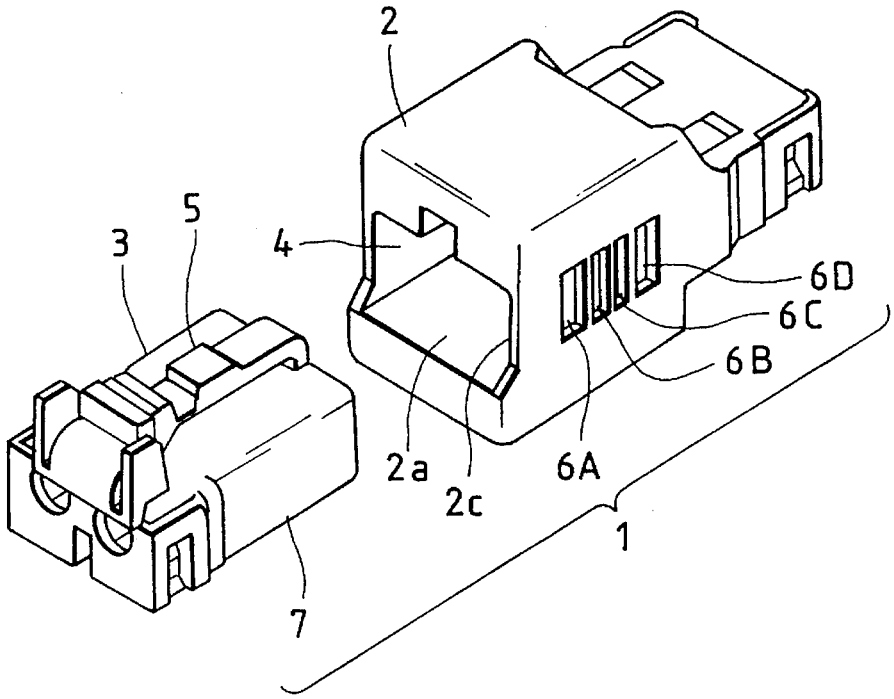
FIG. 7 is a view showing a conventional connector in which housings are separated, FIG. 7(*a*) is a perspective view, and FIG. 7(*b*) is a section view showing a bar code being read by a scanner.
Figure 7B:
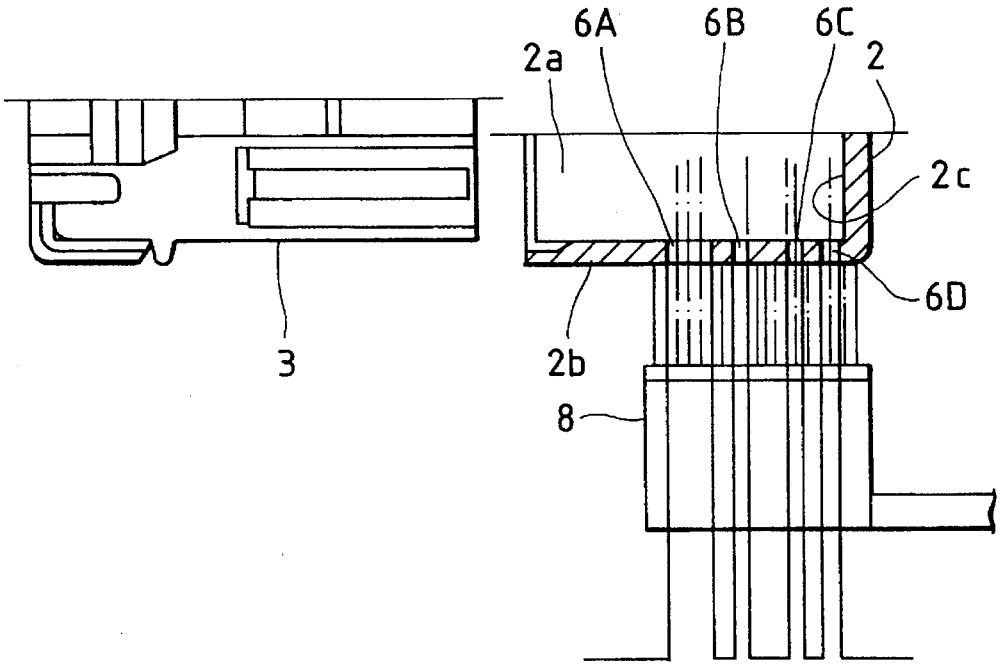
Figure 13A:
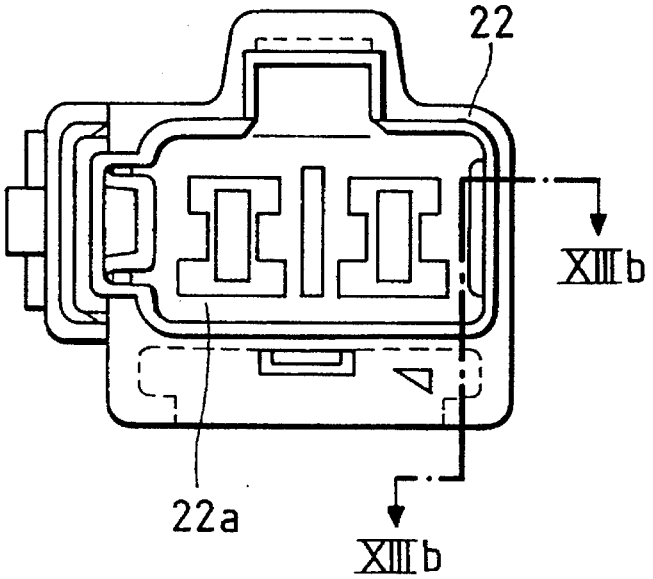
FIG. 13 is an external view of a female housing of a still another conventional connector, FIG. 13(*a*) is a front view, and FIG. 13(*b*) is a plan view along section XIIIb—XIIIb.
Figure 13B:
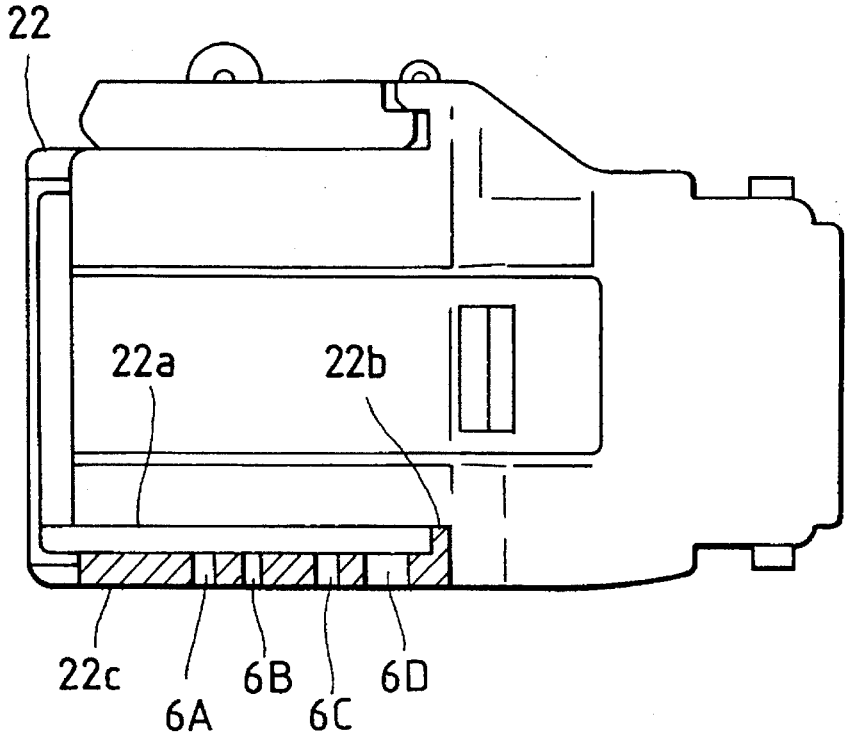
Figure 14:
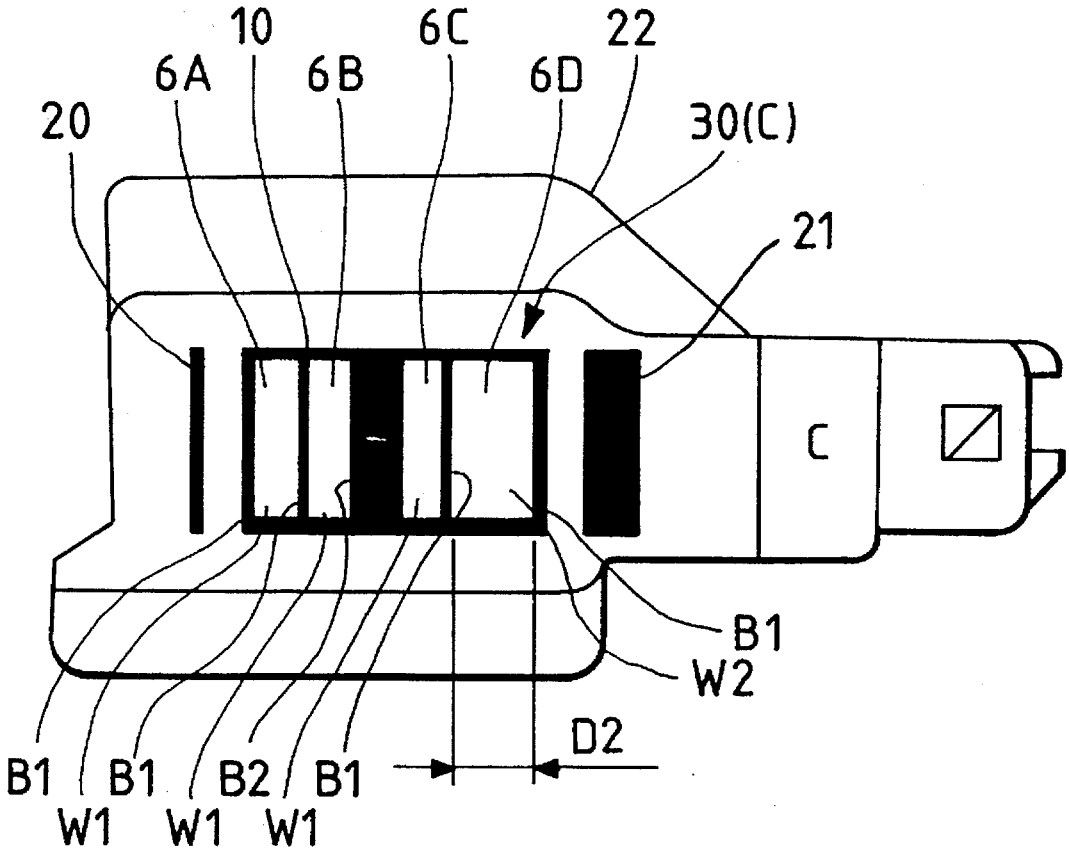
FIG. 14 is a side view of a female housing shown in FIG. 13.

FIGS. 4(*a*) and 4(*b*) show the configuration of a female housing 122 in a connector of a second embodiment. FIGS. 5 and 6 show examples of bar codes 30(A) and 30(C) printed on a side face of the female housing 122. The shape of the female housing 122 is substantially similar to that shown in FIG. 13 except that only a single slit 40 is disposed at the end in the fitting direction. The configuration of the embodiment is similar to that of the female housing 112 of the first embodiment, except for the shape thereof, so that the same effects as those in the first embodiment can be attained.

In the above-described embodiments, the slit 40 is formed in the portion of the white bar W1 or W2. Alternatively, a slit may be formed in the portion of the black bar B1 or B2, and the indicating portion of the male housing may accordingly be coated black. Of course, if the foundation color of the female housing is black, the coating is not required.

As described above, according to the preferred embodiments, a bar code for discriminating the kind of connector is not formed by slits, but formed by printing, and a slit is formed within an area of a bar in a position on the bar code required for the fit failure detection. Therefore, it is unnecessary to differentiate the position and the size of the slit among various kinds of bar code patterns. In other words, if female housings are prepared having an identical shape in which the position and the size of the slit are commonly formed, it is possible to print a number of various bar code patterns depending on the assortment of connectors needed using the position of the slit as the reference. Accordingly, different molds corresponding to different bar code patterns for female housing patterns are not required. When a common mold is used, a large number of differing bar code patterns can be used, and the cost can be reduced. In the complete fit condition, the slit is filled with the indicating portion of the male housing. In a fit failure condition, light from a bar-code reader passes through the slit. As a result, the fit failure of a connector can be detected, based on the difference in a waveform which includes a waveform portion due to the slit portion and which is output from the bar-code reader.

According to another preferred embodiment, all kinds of bar codes can be printed on one kind of female housing. Thus, it is possible to reduce the cost by using a common mold for all kinds of connectors, irrespective of the assortment.

According to yet another embodiment, the foundation color of the female housing and the male housing can be used as it is, so that the load on printing can be reduced.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A connector comprising:

a female housing having a circumferential wall and having a bar code configured by a combination of bars of different colors printed on an outer face; and a male housing adapted to fit into a fitting hole defined by the circumferential wall of said female housing, said male housing having a leading edge portion adapted to reach a desired position in said fitting hole when said male housing and said female housing completely fit together, and having an indicating portion of a color the same as one of said different colors disposed in a portion of a side face of said male housing, said indicating portion adapted to be located adjacent to a slit defined by the circumferential wall of said female housing when said male housing and said female housing completely fit together, the slit extending from said outer face to an inner face, and being formed within an area of a bar of said bar code.

2. A connector according to claim 1, wherein said colors include a white-tone color and a black-tone color.

3. A connector according to claim 1, wherein said bar code includes a first bar of a first width and a second bar of a second width.

4. A connector according to claim 3, wherein a width of said slit is equal the first width, wherein the first width is smaller than the second width.

5. A connector according to claim 3, wherein a width of said slit is less than the first width, wherein the first width is smaller than the second width.

6. A connector according to claim 1, wherein a color of a material of said female housing and said male housing corresponds to the color of said indicating portion.

* * * * *